US006439116B1

(12) United States Patent
Schäfer et al.

(10) Patent No.: US 6,439,116 B1
(45) Date of Patent: Aug. 27, 2002

(54) ARRANGEMENT FOR THE INKER UNIT OF A ROTARY PRESS

(75) Inventors: Karl Robert Schäfer, Rimpar; Georg Schneider, Würzburg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,239

(22) PCT Filed: Dec. 21, 1998

(86) PCT No.: PCT/DE98/03758

§ 371 (c)(1),
(2), (4) Date: Jun. 26, 2000

(87) PCT Pub. No.: WO99/33666

PCT Pub. Date: Jul. 8, 1999

(30) Foreign Application Priority Data

Dec. 24, 1997 (DE) ..... 197 57 897

(51) Int. Cl.[7] ..... B41F 31/00
(52) U.S. Cl. ..... 101/350.6; 118/261
(58) Field of Search ..... 101/207, 208, 101/210, 231, 350.1, 350.5, 350.6, 352.13, 352.11, 367; 118/261, DIG. 15; 492/30, 33–35, 43, 44

(56) References Cited

U.S. PATENT DOCUMENTS

| | | | | | |
|---|---|---|---|---|---|
| 3,098,437 | A | * | 7/1963 | Tyma, Jr. et al. | 101/352.13 |
| 3,974,554 | A | * | 8/1976 | Fantuzzo | 492/35 |
| 4,141,313 | A | * | 2/1979 | Hefele | 118/261 |
| 4,343,260 | A | * | 8/1982 | Yajima et al. | 118/261 |
| 4,432,282 | A | * | 2/1984 | Jurinak | 101/350.5 |
| 4,590,857 | A | * | 5/1986 | Dahl Gren | 101/352.11 |
| 4,700,631 | A | * | 10/1987 | Jurinak | 101/352.11 |
| 4,773,143 | A | | 9/1988 | Okamura et al. | |
| 4,819,558 | A | * | 4/1989 | Couward | 101/352.13 |
| 5,096,407 | A | * | 3/1992 | Nebeling | 492/35 |
| 5,222,434 | A | | 6/1993 | Smith et al. | |
| 5,388,515 | A | | 2/1995 | Schneider et al. | |
| 5,560,294 | A | | 10/1996 | Anders et al. | |
| 6,076,462 | A | * | 6/2000 | Schäfer et al. | 101/350.6 |
| 6,289,807 | B1 | * | 9/2001 | Kutzner et al. | 101/350.6 |

FOREIGN PATENT DOCUMENTS

| | | | |
|---|---|---|---|
| DE | 37 04 433 | | 8/1988 |
| DE | 37 20 053 | | 12/1988 |
| DE | 42 13 662 | | 7/1995 |
| DE | 29718388 | * | 2/1998 |
| EP | 0 663 293 | | 1/1995 |
| FR | 2 263 888 | | 10/1975 |
| JP | 58-192033 | | 12/1983 |
| JP | 7-205413 | | 8/1995 |
| JP | 9-314810 | | 12/1997 |

* cited by examiner

*Primary Examiner*—Eugene Eickholt
(74) *Attorney, Agent, or Firm*—Jones, Tullar & Cooper, P.C.

(57) ABSTRACT

An ink system of a rotary printing press includes a roller and a working doctor blade. The roller has a structured surface which may include helical or annular grooves.

15 Claims, 3 Drawing Sheets

ARRANGEMENT FOR THE INKER UNIT OF A ROTARY PRESS

FIELD OF THE INVENTION

The present invention relates to an arrangement of a working doctor blade on an ink-coated roller. The doctor blade is set against the roller at a negative angle. The roller has a structured surface with endless grooves.

DESCRIPTION OF THE PRIOR ART

A short inking system for offset inks, having an ink feed and a doctor blade arrangement with a negative working doctor blade for an ink metering roller, is known from DE 37 04 433 A1.

DE 42 13 662 C2 shows a chamber doctor blade, wherein the working doctor blade is placed against the surface of an ink-coated roller at a negative setting angle of approximately 40°. The surface of this roller is structured in the form of small cups.

SUMMARY OF THE INVENTION

The present invention was the object of providing an inking system with at least one working doctor blade. This working doctor blade is placed at a negative angle against a roller with a structured surface. The result of this is that it is possible to prevent, to the greatest extent, undesired ink deposits of printing ink on the outer surface of the working doctor blade facing the roller.

In accordance with the present invention, this object is attained by the provision of a working doctor blade that is placed at a negative angle of between 0° and 35° against the surface of an ink-coated roller. The roller has a structured surface which includes endless or helix-like grooves at an angle of inclination or a lead angle of 0° to plus/minus 20°.

The advantages which can be achieved by the present invention reside, in particular in that no unintended formation of ink droplets will occur on the outer surface of doctor blades, in particular working doctor blades. It is thus avoided that, starting at a defined size, the ink droplets are released from the outer surface of the working doctor blade and reach the inking system roller which, follows, which in the end, results in excessive local inking of the printed sheet. This also applies in connection with the use of highly viscous ink of a viscosity of greater than 2 Pa×s, in particular starting at 10 Pa×s.

BRIEF DESCRIPTION OF THE DRAWINGS

The present invention is represented in the drawings by means of preferred embodiments variations.

Shown are in.

DESCRIPTION OF THE PREFERRED EMBODIMENT

Figure 1:
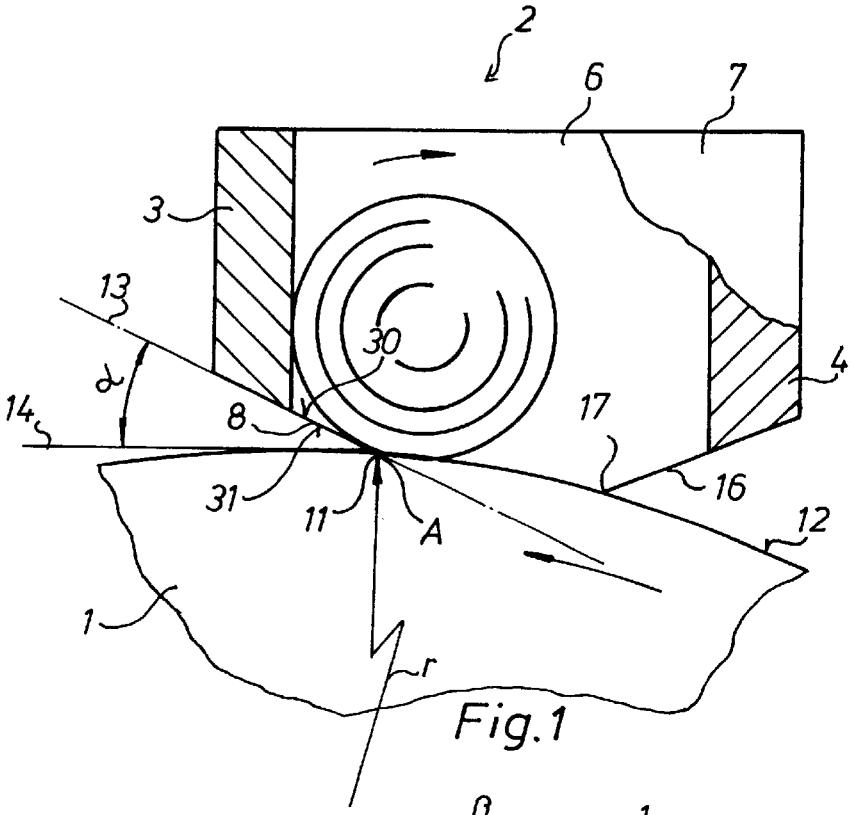
FIG. 1, a cross-sectional view of a schematic representation of a first preferred embodiment of an inking system having an ink metering roller with a structured surface and an ink duct placed on it, which has at least one working doctor blade placed negatively against it, FIG. 2, a front elevation view of the ink metering roller in accordance with FIG. 1 in a representation in reduced size, FIG. 3, a detail "Z" in accordance with FIG. 2 in a cross-sectional view, FIG. 4, a schematic and perspective representation of the grooves in the surface of the ink metering roller in an arrangement in the form of a helical line, FIG. 5, a representation analogous to FIG. 4, but with an annular arrangement of the grooves, FIG. 6, a representation analogous to FIG. 4, but with an arrangement of the grooves in the form of interrupted helical lines, FIG. 7, a schematic representation of a second preferred embodiment generally similar to FIG. 1 and in, FIG. 8, a schematic, greatly enlarged representation of an embodiment of an ink metering roller in accordance with FIGS. 2 and 3.

In its shortest embodiment as seen in FIG. 1, an inking system, for example a short inking system of a rotary printing press, has an ink duct 2, an ink metering roller 1 and an ink application roller, not specifically shown. The surface 12 of the ink metering roller 1 is structured. The ink duct 2 consists of a left lateral wall 3 and a right lateral wall 4 and is closed off at the ends by respectively an end face 6 and an end face 7. The left lateral wall 3 supports a working doctor blade 8 on the bottom of wall 3, which working doctor blade 8 is placed negatively against the ink metering roller 1. The angular direction of the working doctor blade 8 is opposite to, or, against the direction of rotation of the roller 1, as seen in FIG. 1. The outer working edge 11 of the working doctor blade 8 touches the surface 12, or circumference of the ink metering roller 1.

The working doctor blade 8 can be made of metal, for example spring steel, of plastic, for example PE or PMA; or of a fiberglass-reinforced plastic material.

An acute generating angle is identified by $\alpha$ and is defined by two tangential lines 13 and 14, which intersect in a point A. This angle $\alpha$ is shown in FIG. 1.

In the operating position, the edge of the lower front of the working doctor blade 8 facing away from the ink duct i.e., the outer working edge 11, contacts the surface of the ink duct or ink metering roller 1, in a linear direction. The first tangential line 14 is placed against the surface of the ink duct roller 1 at a contact point A of this linear contact line.

In the operating position, the second tangent line 13 is placed against the outer surface of the working doctor blade 8 facing away from the ink duct 2 and is in contact with the contact point A. The generating angle $\alpha$ is called the "setting angle $\alpha$" against the ink duct roller 1 of the working doctor blade 8 in the working position. This setting angle $\alpha$ preferably lies in the range of equal to/greater than 10° and equal to/less than 35°.

The working doctor blade 8 has a first inner surface 30 facing the ink duct, and a second, outer surface 31 facing the ink metering roller 1, and thus facing away from the ink duct.

Figure 2:
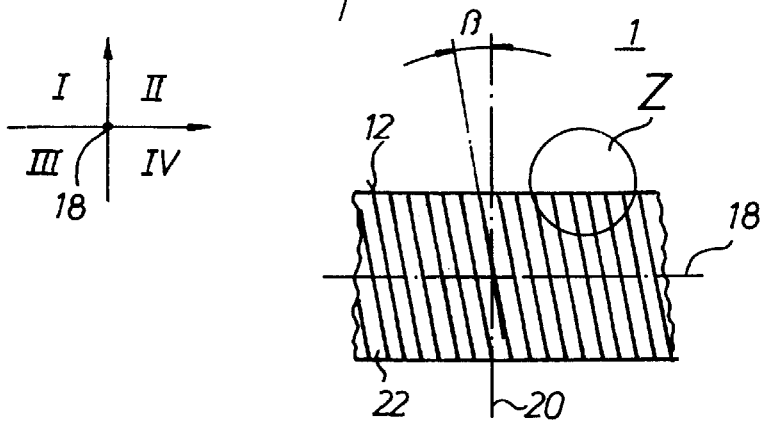

A closing doctor blade 16 is fastened at the bottom of the right lateral wall 4, again as seen in FIG. 1. Its working edge 17 is pressed against the surface of the ink metering roller 1. The ink duct 2 with the doctor blades 8, 16 is arranged above the ink metering roller 1, and is positioned in the I. or II. quadrant, referring to a right-angled coordinate system, whose origin lies on the axis of rotation 18 of the ink metering roller 1 as depicted in FIGS. 1 and 2.

Figure 7:
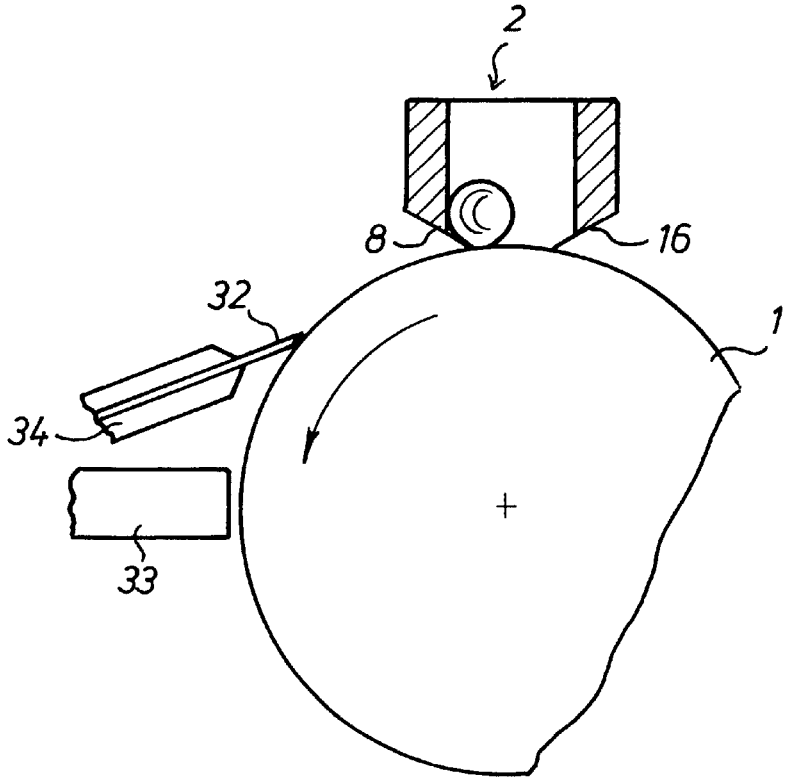

One or more additional working doctor blades 32, fastened on suitable doctor blade holders 34, can be connected downstream—viewed in the direction of rotation of the ink metering roller 1—of the working doctor blade 8. This arrangement is shown in FIG. 7.

The first working doctor blade 8 does necessarily have to not be a component of an ink duct 2. Disconnected from an ink supply, working doctor blade 8 can wipe ink off an ink metering roller 1 which charged with ink, which removed ink is then caught in an ink reservoir 33.

Figure 3:
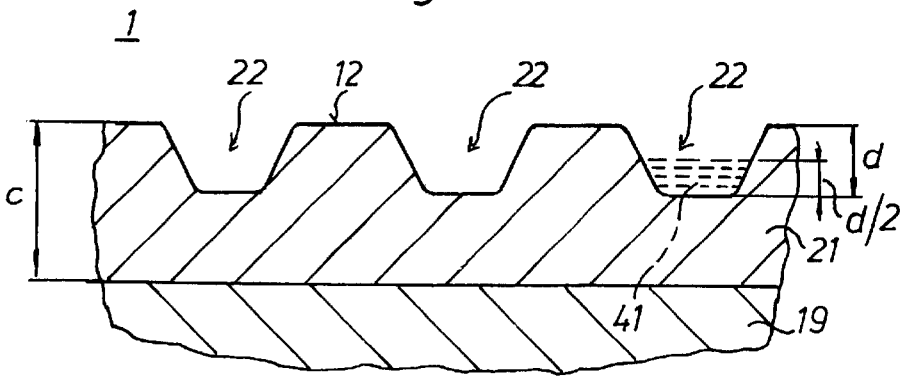
Figure 4:
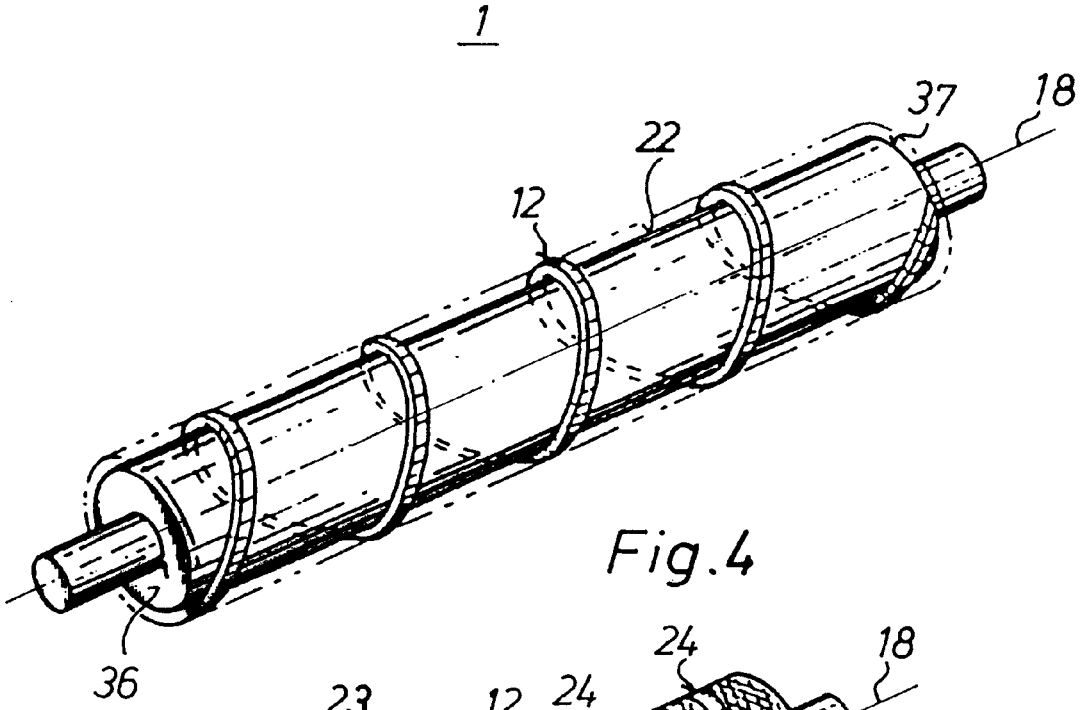

The ink metering roller 1, with which the working doctor blade 8 works, has a tube-shaped steel jacket 19, for example, on which a ceramic layer 21 of a thickness c, for example more than 100 $\mu$m to 400 $\mu$m is applied by, for example, being, sprayed on as seen in FIG. 3 . This ceramic layer 21 has a surface 12 structured or textured by the provision of cut in grooves 22 of any kind, in particular multi-helical grooves 22. These grooves 22 can also be made as simple helixes, double helixes or as multi-helixes. FIG. 4 shows a simplified representation of a multi-helical groove on an ink metering roller 1. The multi-helical grooves 22 extend along the surface 12 of the roller 1 between the two opposing end faces 36, 37 of the ink metering roller 1.

These grooves 22 can have a depth d, as seen in FIG. 3 of for example, 20 $\mu$m. 100 to 400 grooves can be provided per centimeter of the axial length of the ink metering roller 1.

Figure 8:
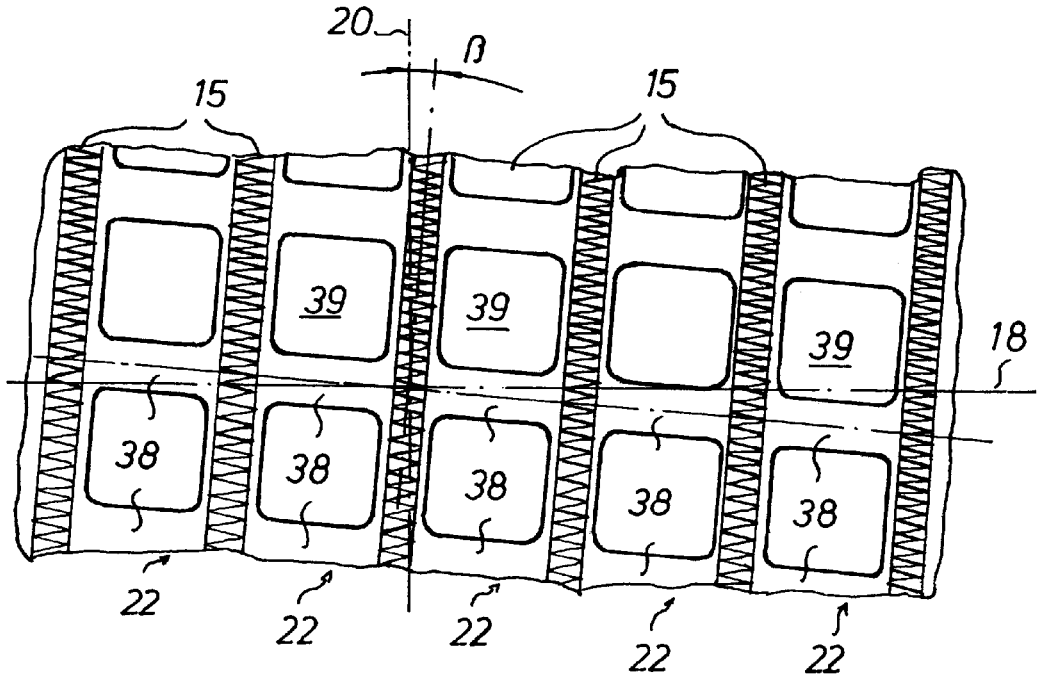

As previously mentioned, these multi-helical grooves 22 have been cut, for example circumferentially, into the surface 12 of the ink metering roller 1. The multi-helical grooves 22 have a lead angle $\beta$, as seen in FIGS. 2 and 8.

The lead angle $\beta$ can lie in the range of between 0 to 20° as shown in FIGS. 2, 4 to 6, and 8. The inclination can rise to the right as seen in FIG. 2 or the left; as depicted in FIG. 4.

Figure 5:
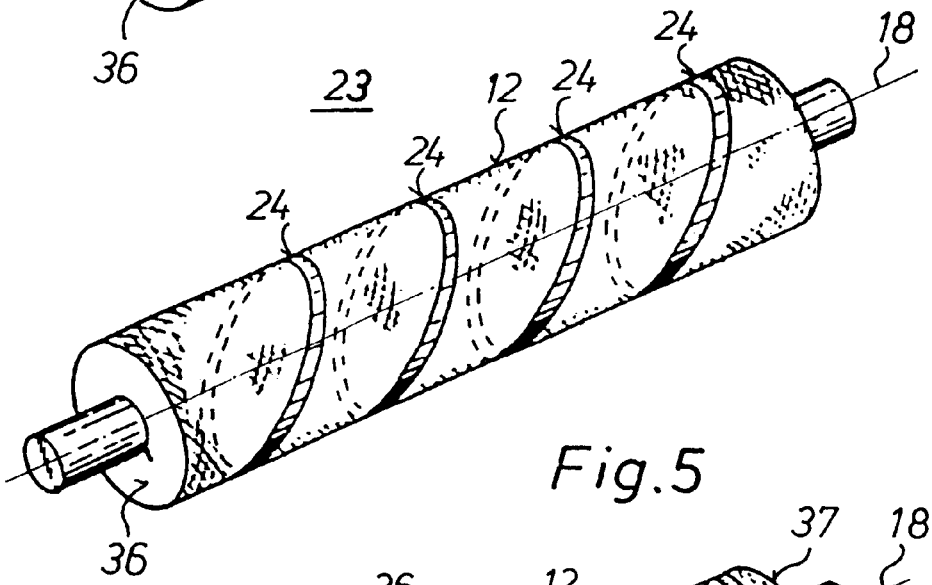

In a further preferred embodiment which is shown in FIG. 5, the ink metering roller 23 has a plurality of endless annular grooves 24 extending around the circumference of its surface.

They are inclined at an angle of inclination "gamma".

The angle of inclination "gamma" is understood to be the angle which the surface enclosed by the annular grooves 24 respectively forms with a vertical plane, with which the axis of rotation 18 of the annular groove 24 and therefore the axis of rotation of the ink metering roller 1 forms a right angle.

The angle of inclination "gamma" preferably lies in the range between 0° and 20°.

Figure 6:
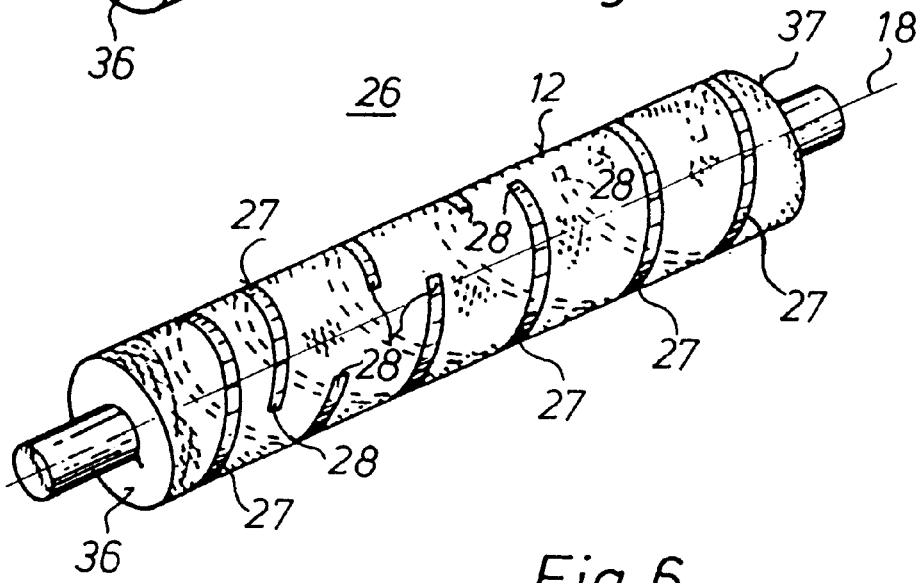

In accordance with a further preferred embodiment as shown in FIG. 6, the ink metering roller 26 has grooves 27 in the form of helical lines which are interrupted as often as desired. In this case, the respective ends 28 of the single-helix grooves 27 are arranged offset in relation to each other. It is to be understood that FIG. 6 is not true to scale.

The ink can be of high viscosity of even greater than 10 PA×s.

No undesired ink droplets, which might lead to over-inking of the printed products, are formed in the area close to the working edge 11, and on the exposed outer surface 31 of the working doctor blade.

In accordance with a further preferred embodiment as shown in in FIG. 8, the above described grooves 22, 24, 27—called grooves 22 in what follows, and which are located between ridges 15, as depicted in FIG. 8, can be respectively interrupted by one or several transverse ridges 38. Elongated "small cups" 39 are formed by this arrangement of circumferential ridges 15 and transverse ridges 38.

Each of the ink metering rollers 1, 23, 26 has an oleophilic surface. This surface can consist of a ceramic material, for example $Cr_2O_3$, of plastic, for example PE or polyamide, of a glass-ceramic material, or of a sufficiently hard, oleophilic material, or respectively of a metal alloy.

The grooves 22, 24, 27 can be partially filled with a lower-located layer 41 of an oleophilic metal, for example copper; or plastic, for example Rilsan, as shown in FIG. 3.

Small cups 39 can be cut into the above mentioned partially filled grooves 22, 24, 27.

The above mentioned small cups 39, however, can also be partially filled, for example, by a layer 41 of copper up to a height d/2—as schematically shown partially filled in FIG. 3, referring to the right groove 22, or to a small cup.

While preferred embodiments of an arrangement for the inker unit of a rotary press in accordance with the present invention have been set forth fully and completely hereinabove, it will be apparent to one of skill in the art that a number of changes in, for example the overall size of the roller, the drive arrangement for the roller, and the like could be made without departing from the true spirit and scope of the present invention which accordingly will be limited only by the following claims.

What is claimed is:

1. An ink system of a rotary printing press comprising:

a working doctor blade having a working edge; and an ink metering roller, said ink metering roller having a structured surface including grooves at an angle in the range of 0° and 20° and wherein said working doctor blade is positioned at a negative setting angle of between 10° and 35° with respect to said roller surface.

2. The ink system of claim 1 further including an ink duct and wherein said working doctor blade is a component of said ink duct.

3. The ink system of claim 1 further including at least one additional working doctor blade contacting said roller surface after, in a direction of rotation of said roller, said working doctor blade.

4. The ink system of claim 1 wherein said grooves are multi-helix grooves.

5. The ink system of claim 1 wherein said grooves are single-helix interrupted grooves.

6. The ink system of claim 1 wherein said grooves are annular grooves.

7. The ink system of claim 1 wherein said grooves include lateral ridges within said grooves.

8. The ink system of claim 1 wherein said ink metering roller is made of a glass-ceramic material.

9. The ink system of claim 1 wherein said ink metering roller is made of a ceramic material.

10. The ink system of claim 1 wherein said ink metering roller is made of plastic.

11. The ink system of claim 1 wherein said grooves include an oleophilic material layer.

12. The ink system of claim 11 wherein said oleophilic material is metal.

13. The ink system of claim 11 wherein said oleophilic material is plastic.

14. The ink system of claim 11 further including cups formed in said oleophilic material layer.

15. The ink system of claim 1 further including a closing doctor blade having a closing doctor blade edge engageable with said roller surface.

* * * * *